US009202648B2

(12) United States Patent
Volpato et al.

(10) Patent No.: US 9,202,648 B2
(45) Date of Patent: Dec. 1, 2015

(54) ELECTRICAL DEVICE WITH AXIAL CONTROL

(71) Applicant: VIMAR S.P.A., Marostica (Vicenza) (IT)

(72) Inventors: Alberto Volpato, Mason Vicentino (IT); Antonio Cavalli, Marostica (IT)

(73) Assignee: VIMAR S.P.A., Marostica (Vicenza) (IT)

( * ) Notice: Subject to any disclaimer, the term of this patent is extended or adjusted under 35 U.S.C. 154(b) by 287 days.

(21) Appl. No.: 13/906,390

(22) Filed: May 31, 2013

(65) Prior Publication Data

US 2013/0327624 A1 Dec. 12, 2013

(30) Foreign Application Priority Data

Jun. 7, 2012 (IT) ..... MI12A0992

(51) Int. Cl.

| | |
|---|---|
| ***H01H 13/56*** | (2006.01) |
| ***H01H 13/28*** | (2006.01) |
| ***H01H 23/20*** | (2006.01) |
| ***H01H 13/14*** | (2006.01) |
| *H01H 23/24* | (2006.01) |

(52) U.S. Cl.

CPC ..... *H01H 13/14* (2013.01); *H01H 13/56* (2013.01); *H01H 23/20* (2013.01); *H01H 23/24* (2013.01)

(58) Field of Classification Search

CPC ..... H01H 23/20; H01H 23/24; H01H 13/14; H01H 13/56; H01H 13/58; H01H 13/562

USPC ..... 200/520, 523, 525, 529–535, 537

See application file for complete search history.

(56) References Cited

U.S. PATENT DOCUMENTS

| | | | | |
|---|---|---|---|---|
| 5,508,485 | A * | 4/1996 | Nishikawa | 200/525 |
| 6,335,500 | B1 * | 1/2002 | Chi et al. | 200/341 |
| 6,680,449 | B1 | 1/2004 | Wang | |

FOREIGN PATENT DOCUMENTS

| | | |
|---|---|---|
| DE | 201 17 514 | 1/2002 |

OTHER PUBLICATIONS

Italian Search Report dated Feb. 19, 2013, corresponding to the Foreign Priority Application No. IT MI20120992.

* cited by examiner

*Primary Examiner* — Amy Cohen Johnson
*Assistant Examiner* — Marina Fishman
(74) *Attorney, Agent, or Firm* — Young & Thompson

(57) ABSTRACT

Electrical device with axial control, such as switch, double-pole switch, toggle switch, inverter or the like, including a box-like containment structure (20) in insulating material, in which are housed: at least two connection terminals (31, 32), at least one fixed electrical contact (35) connected to one (31) of the connection terminals, at least one rocker arm element (36) carrying at least one mobile electrical contact (37) and connected electrically to another (32) of the connection terminals, and an axial actuation member (70) kinematically connected via a first oscillating support (50) to the rocker arm element (36), so as to make it oscillate between two predetermined stable positions, wherein on the first oscillating support (50) acts a second oscillating support (60) which is made to oscillate in one direction or in the other at each actuation of the axial actuation member (70).

10 Claims, 9 Drawing Sheets

ELECTRICAL DEVICE WITH AXIAL CONTROL

FIELD OF THE INVENTION

The invention relates to an electrical device with axial control, such as a switch, double-pole switch, toggle switch, inverter or the like, wherein the switching takes place through the effect of the axial movement of a pushbutton actuation member which causes the displacement of a rocker arm carrying at least one contact mobile between two stable positions.

Herein below particular reference will be made to a switch, i.e. to a device of opening and closure of a single contact, but it is clear that what will be said is applicable to any one of the electrical devices mentioned above, for example wherein the opening of a contact causes the simultaneous closure of another contact and vice versa, such as is the case of a toggle switch.

BACKGROUND OF THE INVENTION

An electrical device of this type normally uses an actuation member which acts, by means of a lever, on the contact holder rocker arm element in order to make it oscillate between one and the other of its stable positions. The actuation member is normally an oscillating key which can be moved between two positions corresponding to the two stable positions of the rocker arm.

In various applications it is required that the actuation of the device takes place, instead of by means of an oscillating key, by means of a pushbutton axial control.

Switches are known with pushbutton control wherein the actuation member acts, by means of appropriate drives, on an oscillating element with overreach of dead centre which causes the movement of the contact holder rocker arm.

U.S. Pat. No. 6,680,449 B1 discloses a press button switch including a seesaw switching mechanism, a spring-supported press button, and a push member pivoted to the spring-supported press button and controlled by the spring-supported press button to slide along two symmetrical endless sliding tracks bilaterally provided inside an housing, to switch the seesaw switching mechanism between on/off positions. The press button is placed at different levels in the on/off position.

Known axial control devices are however subject to improvements as regards the reliability, the economic nature, the simplicity of manufacture and the like.

SUMMARY OF THE INVENTION

The object of the invention is in fact that of providing such an electrical device with axial control which is reliable, economical, of simple manufacture and easy to assemble.

Another object of the invention is that of providing such a device which requires a modest actuation force.

Substantially the device with axial control according to the invention comprises a box-like containment structure in insulating material in which are housed at least two connection terminals, at least one fixed electrical contact connected electrically to one of the two connection terminals, at least a rocker arm element carrying at least one mobile electrical contact and connected electrically to another connection terminal, and a pushbutton actuation member kinematically connected, by means of a first oscillating support, to said rocker arm element so as to make it oscillate between two predetermined stable positions, wherein on said first oscillating support acts a second oscillating support which is made to oscillate in one direction and in the other at each actuation of said pushbutton; the second oscillating support is pivoted to said first oscillating support and separated from said axial actuation member.

BRIEF DESCRIPTION OF THE DRAWINGS

Further features of the invention will be made clearer by the following detailed description, referred to one of its embodiments purely by way of a non-limiting example illustrated in the accompanying drawings, in which.

DETAILED DESCRIPTION OF THE INVENTION

In the accompanying drawings the electrical device with axial control according to the invention is a single-pole switch, and reference will be made thereto in the following detailed description. It is remarked however that the invention can be applied to other types of electrical devices, such as double-pole switches, toggle switches, inverters and the like.

Figure 1:
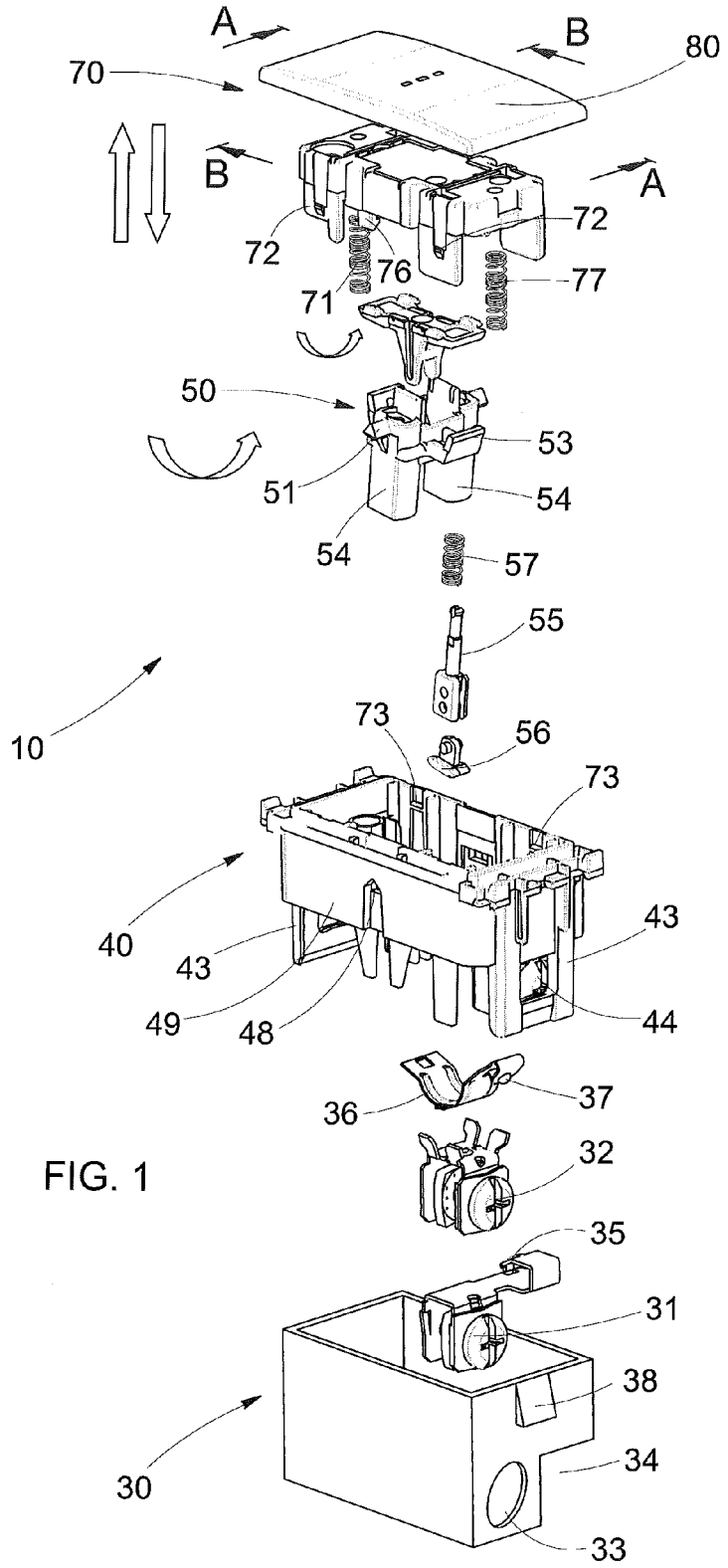
FIG. 1 is an exploded axonometric view of a switch with axial control according to the invention.
Figure 2:
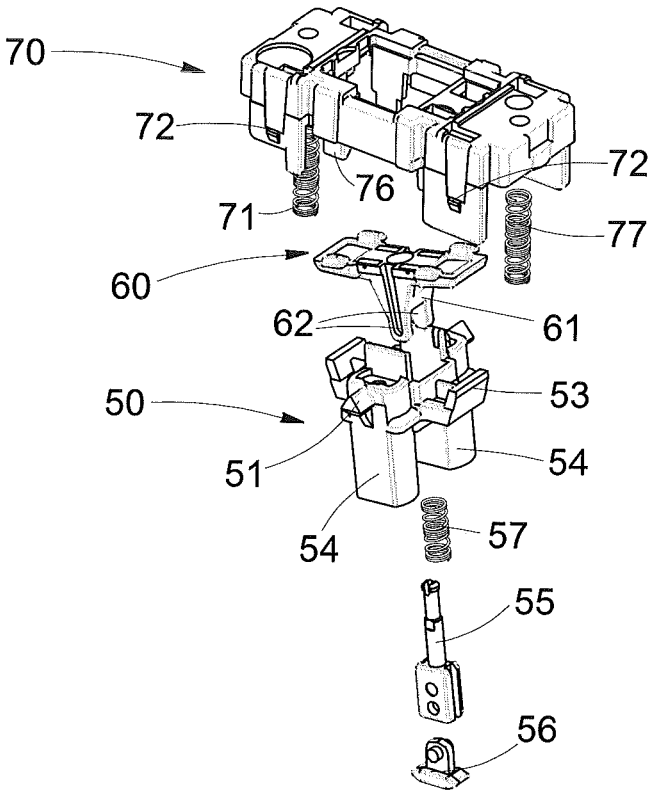
FIG. 2 is an exploded axonometric view showing some of the components of the switch of FIG. 1.

Referring to the accompanying drawings, and in particular at the moment to the exploded view of FIG. 1, reference numeral 10 denotes, as a whole, an electrical switch with axial control according to the invention.

It comprises a box-like structure in insulating material for containment of the components of the switch, denoted by reference numeral 20, and consisting of a contact holder base body 30 and a mechanism holder box 40.

The mechanism holder box 40, in the exploded view of FIG. 1, is shown as a single element and as such will be referred to herein below, for simplicity of description, although it is constituted by two separate elements 41, 42 assembled one with the other, as can be seen clearly from the sectioned views of FIGS. 3-6.

The base body 30 shown schematically in FIG. 1 has the shape of a parallelepiped box open above, in which are housed two connection terminals 31, 32, in the form of screw clamps accessible through respective apertures 33, 34 provided on one or more walls of the body 30.

In the example shown, integral with the connection terminal 31 is a fixed phase contact 35, while on the other connection terminal 32 rests a rocker arm element 36, carrying a mobile phase contact 37. As will be better described herein below, the rocker arm element 36 is able to oscillate between a first stable position wherein the mobile contact 37 is applied with a certain pressure on the fixed contact 35 closing the electrical circuit associated to the switch, and a second stable position wherein the mobile contact is spaced away from the fixed contact 35, opening the electrical circuit. Naturally the connection terminals and the relative electrical contacts are made in a metal material with good electrical conductivity, while all the other components of the switch which will be described herein below, unless otherwise specified, are conveniently made in insulating material, more particularly in plastic material.

The mechanism holder box 40, so called because it houses the components of actuation of the rocker arm element 36, has the same parallelepiped shape of the base body 30, and is attached thereto by means of a pair of opposite fins 43 extended below from its smaller faces and having respective apertures 44 suitable for engaging with corresponding teeth 38 provided on corresponding opposite faces of the base body 30.

Figure 7:
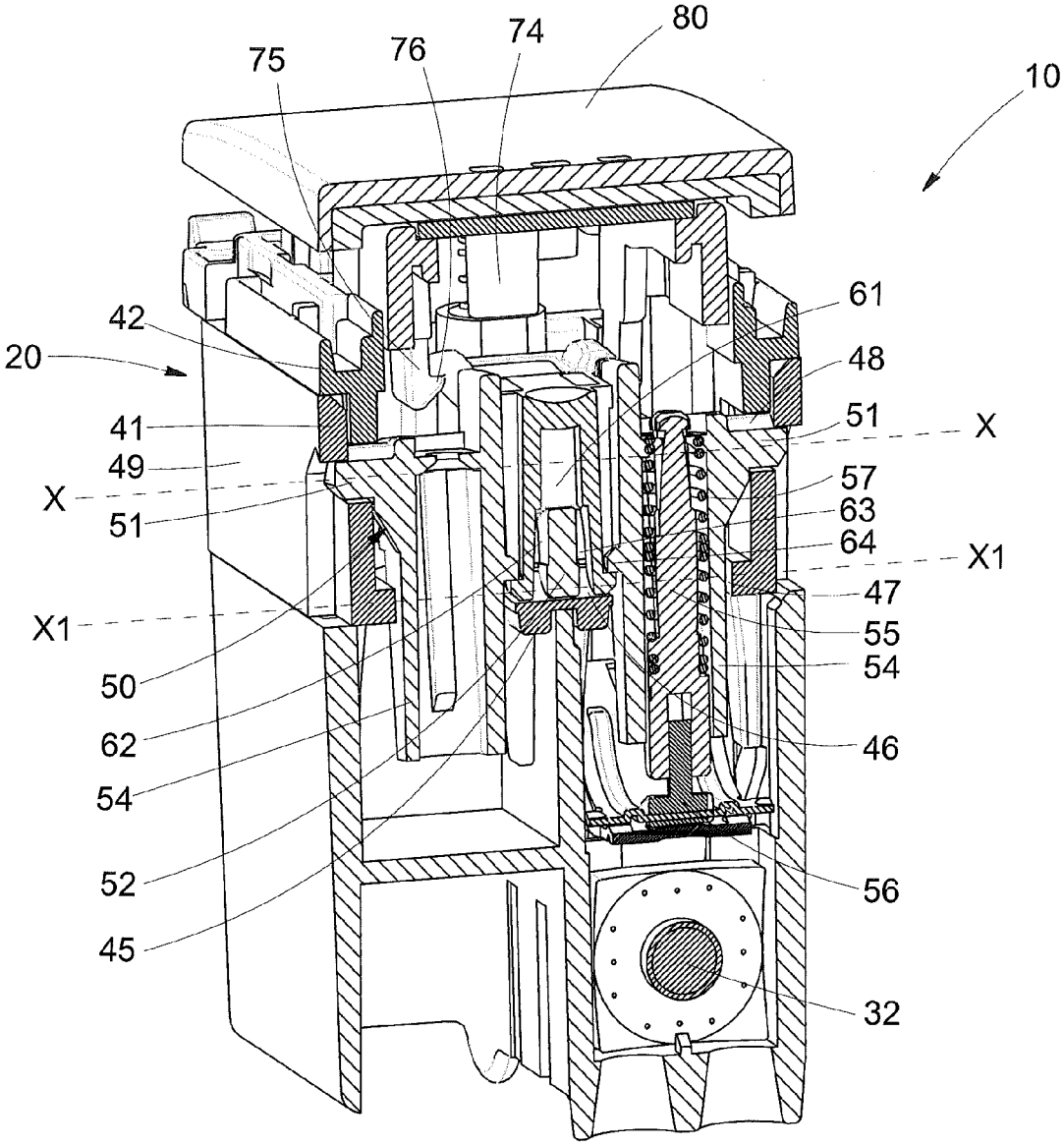
FIG. 7 is a cross-section axonometric view, taken on a plane orthogonal to that of FIGS. 3-6, in the direction of the arrows B-B of FIG. 1, with the switch in the rest condition.
Figure 9:
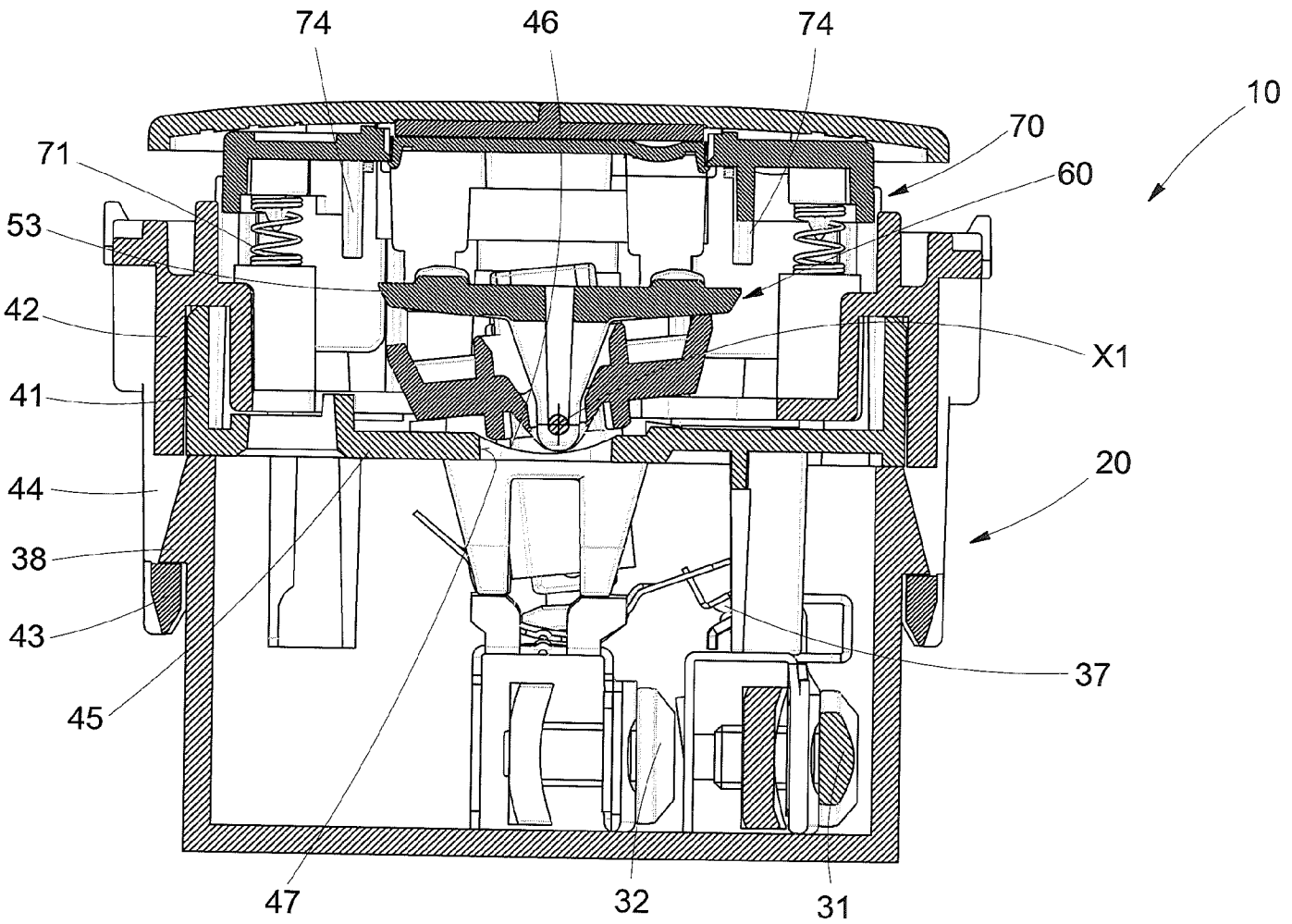
FIG. 9 is a cross-section like that of FIG. 6, taken along a slightly staggered plane.

The mechanism holder box 40 is open above and has a bottom wall 45 with a central seat 46 slightly concave in the longitudinal direction, i.e. in the direction of its two smaller faces, and two apertures 47 placed at the two sides of said concave seat 46, in the transverse direction of the box 40 (see more particularly FIGS. 7 and 9).

Figure 8:
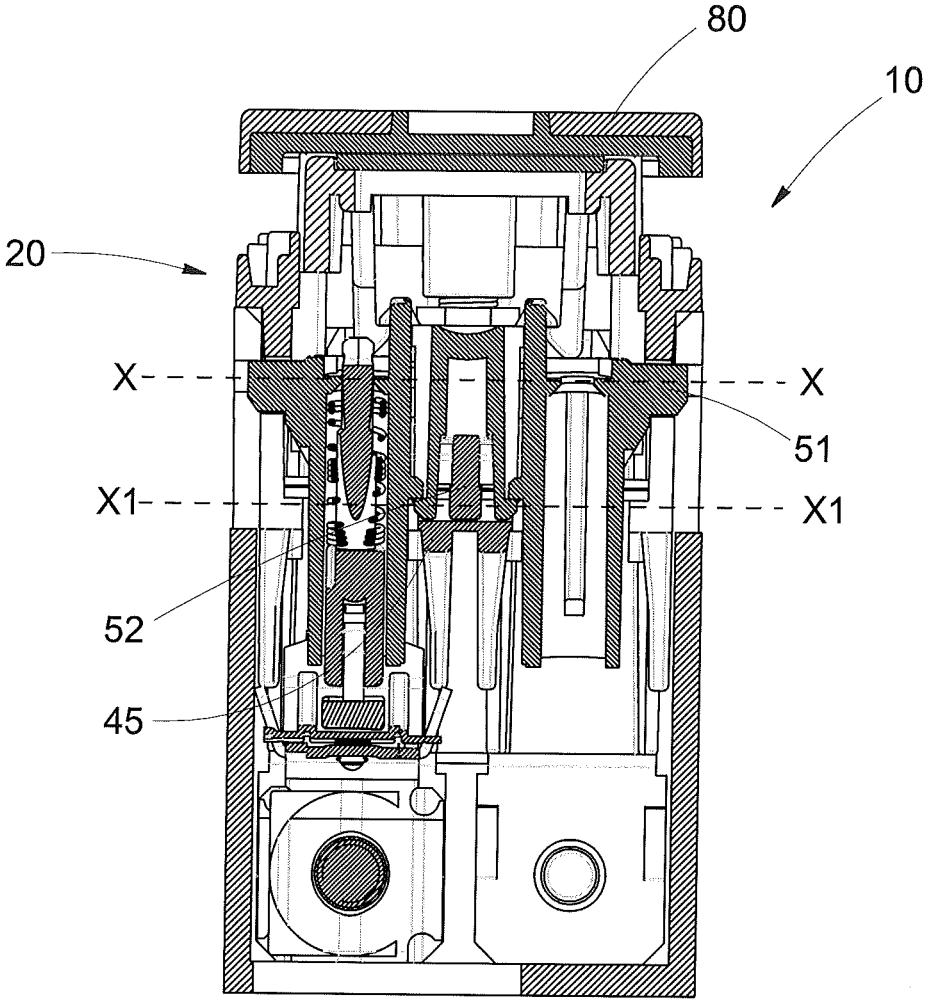
FIG. 8 is a plane cross-section like that of FIG. 7, looking in the opposite direction.

In the box 40 there is housing for a first oscillating support 50, able to oscillate around an axis of fulcrum X formed by two opposite projections 51 which are housed in corresponding holes 48 formed in the opposite larger walls or faces 49 of the box 40 (see FIGS. 1, 7 and 8).

The first oscillating support 50 has a central section 52 convex below, suitable for resting and sliding in the concave seat 46 of the bottom wall 45 of the box 40, and two opposite end projections 53 slightly splayed upwards. At the two sides of said central section 52 two vertical uprights 54, hollow internally, are placed, traversing said apertures 47 formed in the bottom wall 45 of the box 40 (FIG. 7).

In one of said hollow uprights 54 (the rear one with reference to the accompanying drawings) is housed a piston 55 carrying below an articulated slide 56 held under pressure by a spring 57 on the oscillating element 36. The spring 57 can obviously be made in metal material.

In the single-pole switch embodiment shown in the accompanying drawings, wherein a single oscillating element 36 is provided with mobile contact 37, only one of the two hollow uprights 54 houses a corresponding piston 55 of actuation of the oscillating element 36, as will be stated herein below, but it is clear that in other embodiments of the electrical device with axial control according to the invention, for example in the case of an inverter, two oscillating elements 36 can be provided, in which case both the hollow uprights 54 will house a respective piston 55.

Pivoted to the first oscillating support 50 around an axis X1 (FIGS. 7, 8, 9) is a second oscillating support 60, having the form of a substantially horizontal plate, with a lower central protuberance 61 resting on the first oscillating support 50, wherefrom two opposite feet 62 branch off, traversing respective slots 63 formed in the first oscillating support 50 and engaging below opposite teeth 64 projecting internally from said hollow uprights 54.

Above the box 40 is placed an actuation member 70 of the axial control switch, i.e. of the pushbutton type with the possibility of sliding vertically in the two directions, with a limited travel, inside the box 40.

The axial actuation member 70 has the form of a rectangular frame of such dimensions as to be housed perfectly inside the box 40, with respect whereto it is held normally raised by the action of two springs 71, which can obviously be of metal material. The detachment of the actuation member 70 from the box 40 is prevented by pairs of opposite teeth 72 provided on the external walls of the member 70, which engage with corresponding teeth 73 provided on the internal walls of the box 40 (FIG. 1).

Below the member 70 project two stems 74 intended to go alternately in contact with one end of the second oscillating support 60 at each actuation thereof, according to the angular position of the first oscillating support 50, as will be explained herein below. Below from the actuation member 70 likewise project two pairs of opposite fins 75 provided with teeth 76 suitable for hooking from below the second oscillating support 60 in order to return it always in horizontal position at each actuation.

Slotted on the axial actuation member 70 is an interchangeable covering element 80 with purely aesthetic function.

Referring to FIGS. 3 to 6 a description will now be given of the principle of operation of the switch with axial control according to the invention.

Figure 3:
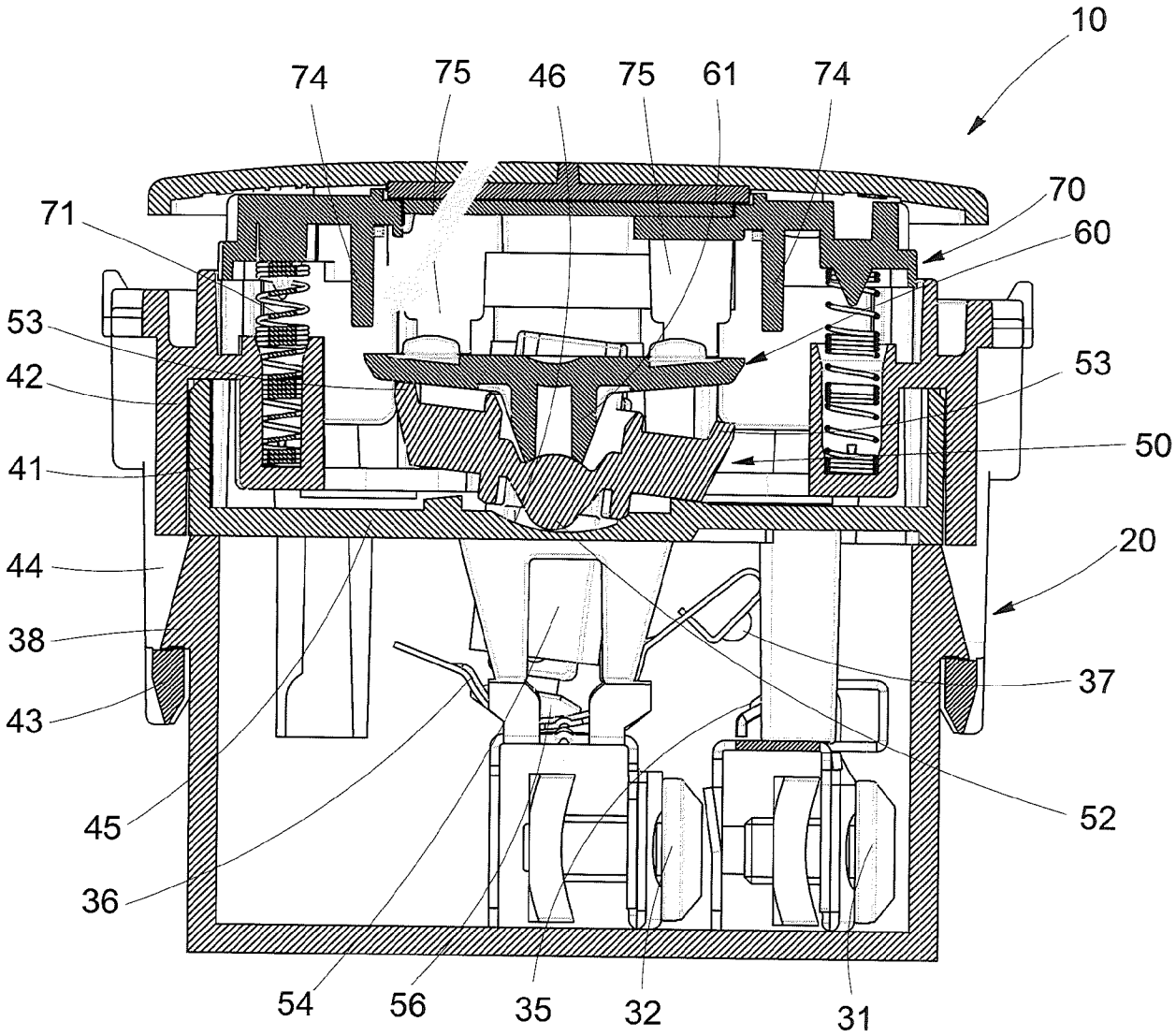
FIG. 3 is a median cross-section view of the assembled switch in the rest condition, with open contacts, taken in the direction of the arrow A-A of FIG. 1.
Figure 4:
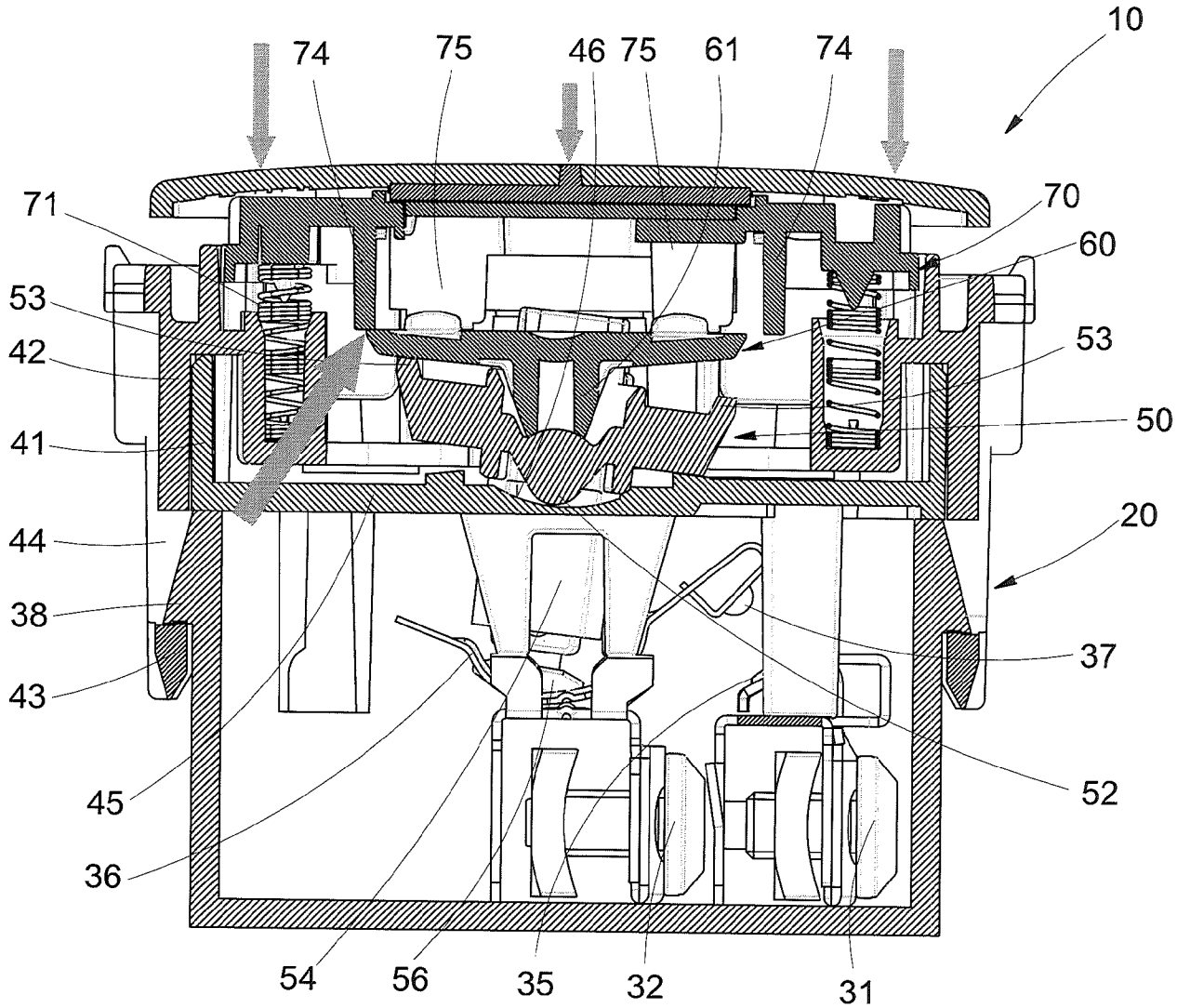
FIGS. 4 to 6 are views similar to that of FIG. 3, illustrating successive phases during the actuation of the axial control, showing the principle of operation of the switch according to the invention.

The configuration of FIG. 3 corresponds to the rest position with contacts open, wherein the axial actuation member 70 is pushed upwards by the springs 71, and is held distanced by the second oscillating support 60, which is in the horizontal position held by the pairs of teeth 76. In this position the first oscillating support 50 is tilted upwards to the left through the effect of the pressure which the spring 57 exerts on the piston 55 and consequently on the rocker arm element 36 via the articulated slide 56. By exerting a pressure downwards on the actuation member 70, in contrast to the action of the springs 71, the left stem 74 projecting below from the member 70 brings itself into contact with the corresponding end of the second oscillating support 60 (FIG. 4).

By continuing to press axially the actuation member 70, the latter pushes on the second oscillating support 60, which causes the rotation anticlockwise around the axis of fulcrum X of the first oscillating support 50, whereto it is pivoted along the axis X1.

Figure 5:
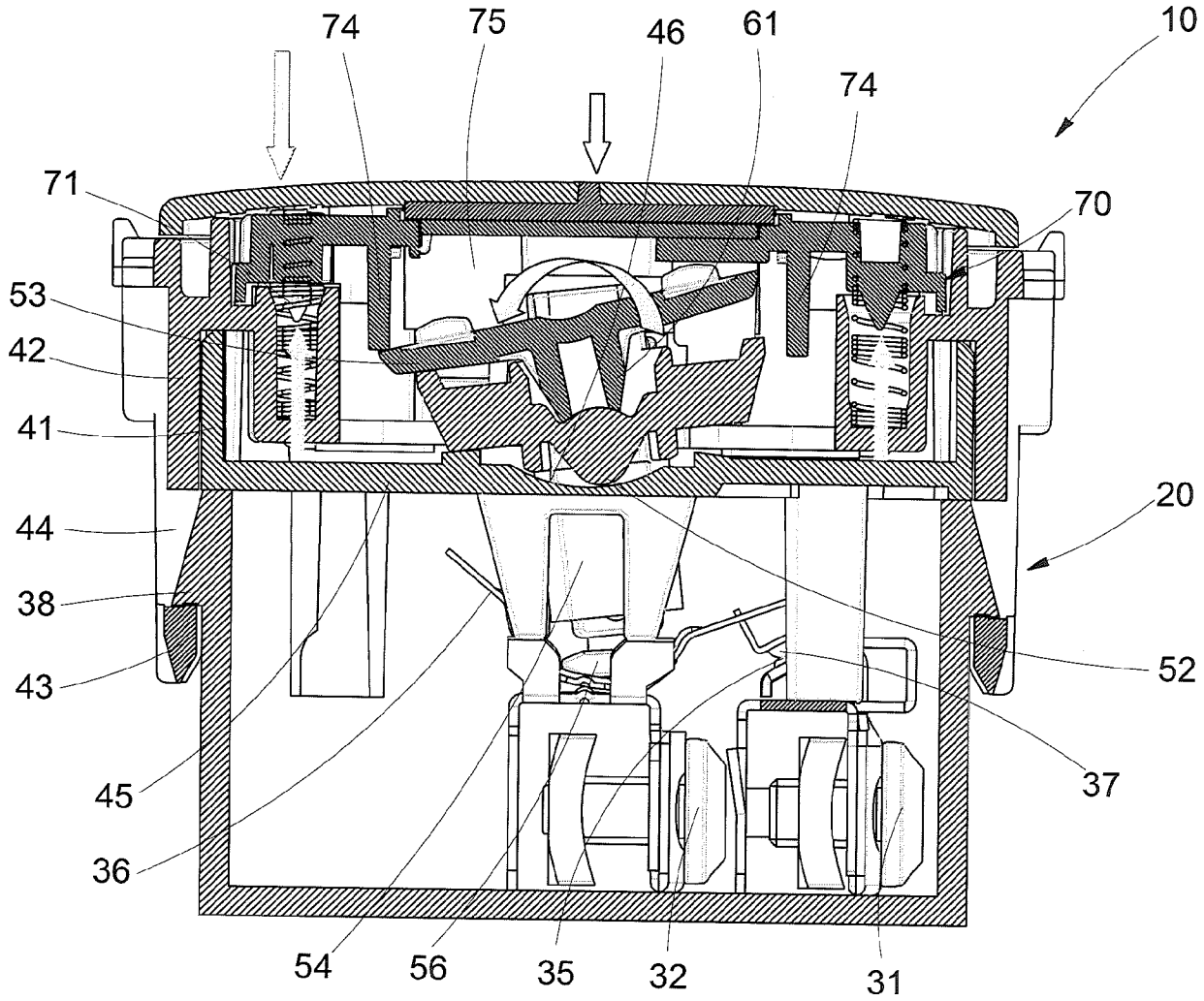

The rotation of the first oscillating support 50 causes a sliding to the right (anticlockwise) of the articulated slide 56 on the rocker arm element 36 against which it is pushed by the spring 57 acting on the piston 55, causing the closure of the contacts (FIG. 5).

Figure 6:
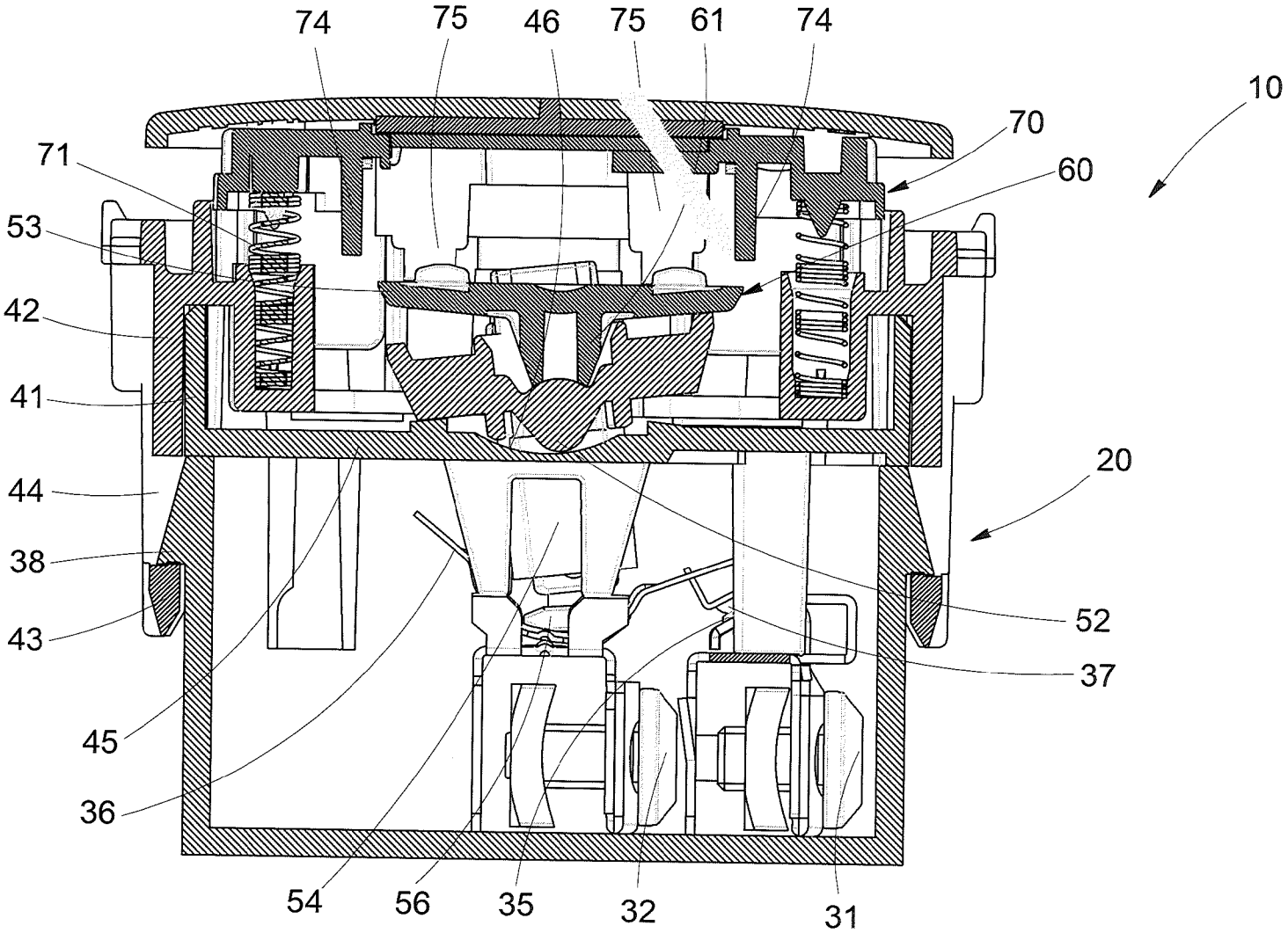

At this point, releasing the pressure exerted manually on the actuation member 70, which has arrived at end of travel, the springs 71 begin to push the actuation member 70 upwards and the teeth 76 provided on the actuation member 70 return the second oscillating support 60 in horizontal position causing the re-arming of the mechanism (FIG. 6).

The configuration of FIG. 6 corresponds to the starting one of FIG. 3, with the difference that now the first oscillating support 50 is tilted in a contrary direction, so that a subsequent actuation of the member 70 will cause the engaging of the right stem 74 with the corresponding end of the second oscillating support 60, repeating in contrary direction the cycle previously described.

From what has been disclosed the advantages appear clear of the electrical device with axial control according to the invention.

More particularly, the provision of the second oscillating support pivoted on the first oscillating support and held in horizontal position by the axial actuation member 70 means that the force of actuation is lower, as the working arm is greater with respect to similar articles of the prior art.

Naturally the invention is not limited to the particular embodiment previously described and illustrated in the accompanying drawings, but instead numerous detail changes can be made thereto, within the reach of the person skilled in the art, without thereby departing from the scope of the invention as defined in the annexed claims.

The invention claimed is:

1. A pushbutton electrical device comprising:

a box-like containment structure (20) in insulating material, in which are housed:

at least two connection terminals (31, 32), at least one fixed electrical contact (35) connected to one (31) of the connection terminals, at least one rocker arm element (36) carrying at least one mobile electrical contact (37) and connected electrically to another (32) of the connection terminals, and an axial actuation member (70) kinematically connected, by means of a first oscillating support (50), to said rocker arm element (36), so as to make it oscillate between two predetermined stable positions, wherein, a second oscillating support (60) having the form of a substantially horizontal plate, with a lower central protuberance (61) resting on the first oscillating support (50), acts on said first oscillating support (50) which is made to oscillate in one direction or in the other at each actuation of said axial actuation member (70), said actuation member (70) being provided with two downwardly protruding stems (74), suitable for alternately acting on one or the other of two opposite ends of said second oscillating support (60).

2. The device according to claim 1, wherein said box-like containment structure (20) comprises a base body (30) housing said connection terminals (31, 32) accessible through respective holes (33, 34) and the corresponding fixed contact (35) and mobile contact (37), and a mechanism holder box (40) attached to the base body (30) and housing components of the device.

3. The device according to claim 2, wherein said first oscillating support (50) is pivoted to said box (40) so as to be able to oscillate around a first axis (X) between two positions inclined in opposite directions corresponding to the two stable positions of said rocker arm element (36), and said second oscillating support (60) is pivoted to the first oscillating support (50) so as to oscillate around a second axis (X1) parallel to the first axis (X), said second oscillating support (60) being normally held in horizontal position by said actuation member (70), at every pressure exerted on said actuation member (70), the second oscillating support (60) acting alternately on one of two opposite ends (53) of the first oscillating support (50) in order to cause the rotation thereof between the one and the other of said inclined positions.

4. The device according to claim 1, wherein a piston (55) is interposed between said at least one rocker arm element (36) and said first oscillating support (50), the piston (55) movable together with the first oscillating support (50) and held under pressure on the rocker arm element (36) by a spring means (57).

5. The device according to claim 4, wherein said piston (55) acts on said rocker arm element (36) by means of an articulated slide (56).

6. The device according to claim 2, wherein said actuation member (70) is held hooked in said mechanism holder box (40) by pairs of co-operating teeth (72, 73) and is pushed upwards by spring means (71).

7. The device according to claim 2, wherein said first oscillating support (50) rests slidingly on a concave seat (46) provided on the bottom wall (45) of said mechanism holder box (40), and has two hollow uprights (54) traversing respective holes (47) formed in said bottom wall (45) of the box (40), each hollow upright (54) being able to house a respective piston (55) and relative spring (57).

8. The device according to claim 2, wherein said mechanism holder box (40) consists of two elements (41, 42) assembled together.

9. The device according to claim 1, wherein an interchangeable covering element (80) is slotted on said actuation member (70).

10. An electrical device with axial control, comprising:

a box-like containment structure (20) in insulating material, in which are housed:

at least two connection terminals (31, 32), at least one fixed electrical contact (35) connected to one (31) of the connection terminals, at least one rocker arm element (36) carrying at least one mobile electrical contact (37) and connected electrically to another (32) of the connection terminals, and an axial actuation member (70) kinematically connected, by means of a first oscillating support (50), to said rocker arm element (36), so as to make it oscillate between two predetermined stable positions, wherein, a second oscillating support (60), which is made to oscillate in one direction or in the other at each actuation of said axial actuation member (70), acts on said first oscillating support (50), said second oscillating support (60) being pivoted to said first oscillating support (50) and separated from said axial actuation member (70), wherein said box-like containment structure (20) comprises a base body (30) housing said connection terminals (31, 32) accessible through respective holes (33, 34) and the corresponding fixed contact (35) and mobile contact (37), and a mechanism holder box (40) attached to the base body (30) and housing components of the device, and wherein said first oscillating support (50) rests slidingly on a concave seat (46) provided on the bottom wall (45) of said mechanism holder box (40), and has two hollow uprights (54) traversing respective holes (47) formed in said bottom wall (45) of the box (40), each hollow upright (54) being able to house a respective piston (55) and relative spring (57).

* * * * *